US006876343B2

(12) United States Patent
Myoung et al.

(10) Patent No.: US 6,876,343 B2
(45) Date of Patent: Apr. 5, 2005

(54) METHOD FOR DRIVING PLASMA DISPLAY PANEL

(75) Inventors: DaeJin Myoung, Kyounggido (KR); Tae Hyung Kim, Seoul (KR); Dai Hyun Kim, Kyounggido (KR); Jong Woon Kwak, Seoul (KR); Geun Soo Lim, Kyounggido (KR)

(73) Assignee: LG Electronics Inc., Seoul (KR)

( * ) Notice: Subject to any disclaimer, the term of this patent is extended or adjusted under 35 U.S.C. 154(b) by 305 days.

(21) Appl. No.: 10/303,973

(22) Filed: Nov. 26, 2002

(65) Prior Publication Data

US 2003/0189533 A1 Oct. 9, 2003

(30) Foreign Application Priority Data

Apr. 4, 2002 (KR) ..... P2002-18544

(51) Int. Cl.[7] ..... G09G 3/28
(52) U.S. Cl. ..... 345/67

(58) Field of Search ..... 345/60–72

(56) References Cited

U.S. PATENT DOCUMENTS

2003/0006945 A1 * 1/2003 Lim et al. ..... 345/67

* cited by examiner

*Primary Examiner*—Richard Hjerpe
*Assistant Examiner*—Rodney Amadiz
(74) *Attorney, Agent, or Firm*—Fleshner & Kim, LLP

(57) ABSTRACT

Method for driving a plasma display panel, wherein a pulse of ramp-down waveform is applied to scan electrode lines between a sustain period of a last selective write sub-field and an address period of a first selective erase sub-field continuous thereto, or between the sustain period of a preceding selective erase sub-field and the address period of a next selective erase sub-field continuous thereto after the first selective erase sub-field, whereby causing more stable address discharge at a higher sustain voltage, or a lower selective erase scan voltage.

18 Claims, 10 Drawing Sheets

METHOD FOR DRIVING PLASMA DISPLAY PANEL

This application claims the benefit of the Korean Application No. P2002-18544 filed on Apr. 4, 2002, which is hereby incorporated by reference.

BACKGROUND OF THE INVENTION

1. Field of the Invention

The present invention relates to a plasma display panel, and more particularly, to a method for driving a plasma display panel, for making a stable address discharge.

2. Background of the Related Art

The plasma display panel (hereafter called as "PDP") is a device for displaying a picture including characters, or graphics by making phosphor luminescent by a UV ray emitted when inert gas mixture (He+Xe, Ne+Xe, or He+Xe+Ne) discharges. The PDP has advantages in that fabrication of a large sized thin screen is easy, and provides a significantly improved picture quality owing to recent technical development.

Typically, the PDP is provided with three electrodes driven by an AC voltage, which is called as an AC surface discharge type PDP. The AC surface discharge type PDP has advantages of a low voltage drive and a long lifetime because wall charges are accumulated on a surface during discharge, and electrodes are protected from sputtering caused by the discharge.

A discharge cell of a related art AC PDP of surface discharge type having 3-electrodes is provided with a scan electrode Y and a sustain electrode Z formed on a front substrate (not shown), and an address electrode X formed on a back substrate (not shown). The address electrode X is formed in a direction perpendicular to a direction of the address electrode X and the scan electrode Y.

There are a front dielectric (not shown) and a protective layer (not shown) stacked on the front substrate having the scan electrode Y and the sustain electrode Z formed in parallel. The wall charges generated in the plasma discharge are accumulated on the front dielectric.

The protective layer prevents the front dielectric from damage caused by sputtering during the plasma discharge, and enhances an emissive efficiency of secondary electrons. In general, the protective film is formed of magnesium oxide MgO.

There are back dielectric (not shown) and barrier ribs (not shown) on the back substrate having the address electrode X formed thereon. Phosphor (not shown) is coated on surfaces of the back dielectric and the barrier ribs.

The barrier ribs are formed in parallel with the address electrode X, for prevention of optical, or electrical interference between adjacent cells on the back substrate. That is, the barrier ribs prevent leakage of the UV ray and visible light produced by discharge to adjacent discharge cells.

The phosphor is excited by the UV ray emitted during the plasma discharge, to emit one of red, green, and blue visible lights. A discharge space formed between the two substrates has inert gas mixture (He+Xe, Ne+Xe, or He+Xe+Ne) injected therein for gas discharge.

Referring to FIG. 1, the discharge cells have an array of a matrix. As shown in an electrode arrangement in FIG. 1, one discharge cell 1 is provided with scan electrodes Y1–Ym and sustain electrodes Z1–Zm running in parallel, and a discharge cell at every crossing part of the parallel two electrodes Y1–Ym and Z1–Zm, and the address electrodes X1–Xm.

The scan electrode lines Y1~Ym are driven progressively, and the sustain electrode lines Z1~Zm are driven in common. The address electrode lines X1~Xn are driven, with odd numbered lines and even numbered lines divided.

The AC PDP of surface discharge type having 3-electrodes has a driving time period divided into a plurality of sub-fields for displaying one frame of a particular gradation. The gradation can be displayed by making emission of light for a number of times proportional to a weight of a video data in each of sub-field duration.

FIG. 2 illustrates one example of a frame structure for driving a related art PDP.

Referring to FIG. 2, the AC PDP of surface discharge type having 3-electrodes is driven, with one frame time period divided into 12 sub-fields (SF1~SF12). More particularly, the one frame time period of each discharge cell 1 is divided into sub-fields of selective write type (SF1~SF6), and sub-fields of selective erase type (SF7~SF12).

The sub-fields of selective write type display low gradations by sustaining discharges at selected and turned on discharge cells, and the sub-fields of selective erase type display high gradations by turning off cells turned on in a last selective write sub-field out of the sub-fields of selective write type.

The first sub-field SF1 is divided into a reset period for resetting an entire screen, a selective write address period for lighting selected discharge cells, a sustain period for sustaining sustain discharges at discharge cells selected by the address discharge, and an erase period for erasing the sustain discharge.

Each of the second to fifth sub-fields SF2~SF5 is divided into a selective write address period, a sustain period, and an erase period. The sixth sub-fields SF6 is divided into a selective write address period, and a sustain period.

Particularly, in the first to sixth sub-fields SF1~SF6, the selective write address period and the erase period in each of the sub-fields SF1~SF6 are set in the same ratios. However, the sustain period of each of the sub-fields SF1~SF6 is given a time weight different from each other in a ratio of 2 to the Nth power (N=0, 1, 2, 3, - - - , 7). That is, the sustain periods are increased in ratios of 1:2:4:8:16:32:64:128 from the first sub-field SF1 to the eighth sub-field SF8.

Each of the next seventh to twelfth sub-fields SF7~SF12 is divided into a selective erase address period for turning off selected discharge cells without a writing period, and a sustain period for sustaining discharges at the discharge cells except the discharge cells selected by the address discharge.

In the seventh to twelfth sub-fields SF7~SF12, the selective erase address period and the sustain period are set to be in the same ratios. Particularly, the sustain period of each of the seventh to twelfth sub-fields SF7~SF12 is set to have the same luminance relative ratio with the sixth sub-field SF6.

The seventh to twelfth sub-fields SF7~SF12 driven in the selective erase type are required that a prior sub-field is in a turned on state without fail every time the sub-fields are continuous for turning off unnecessary discharge cells. For an example, for lighting the seventh sub-field SF7, it is required that the sixth sub-field SF6 driven in selective write type is turned on. After having the sixth sub-field SF6 turned on, unnecessary discharge cells out of the seventh to twelfth sub-fields SF7~SF12 are turned off in a progression.

For using the selective erase sub-fields ESF SF7~SF12 of selective erase type, it is required that the discharge cells turned on in the sixth sub-field SF6, the last selective write field WSF is sustained in a turned on state by sustain discharges.

Accordingly, the seventh sub-field requires no separate writing discharge for the selective erase addressing. Moreover, the eighth to twelfth sub-fields SF8~SF12 also turn off cells turned on in a prior sub-field without writing on entire screen.

FIG. 3 illustrates a waveform diagram showing on example of driving waveforms in driving a PDP according to the frame in FIG. 2.

Referring to FIG. 3, in the reset period of the selective write sub-field SW, a reset pulse of ramp-up waveform RP is provided to the scan electrode lines Y in an initial set-up period SU. The reset pulse of ramp-up waveform RP causes a set-up discharge in discharge cells on entire screen, to accumulate wall charges of positive polarity (+) on the address electrode lines X and the sustain electrode lines Z, and wall charges of negative polarity (−) on the scan electrode lines Y.

Then, in the set-down period SD, a reset pulse of ramp-down waveform (−RP) is provided to the scan electrode lines Y. The reset pulse of ramp-down waveform (−RP) has a declining waveform starting from a voltage of positive polarity lower than a peak voltage of a reset pulse of ramp-up waveform (RP) after the reset pulses of ramp-up waveform (RP) is provided. The reset pulse of ramp-down waveform (−RP) drops down to a first scan reference voltage Vyw1 of negative polarity (−).

While the reset pulse of ramp-down waveform (−RP) is provided to the scan electrode lines Y, a first DC voltage of positive polarity (+) is provided to the sustain electrode lines Z. That is, at the time the reset pulse of ramp-down waveform (−RP) is provided, the first DC voltage of positive polarity (+) is started to be provided to the sustain electrode lines Z. The first DC voltage Zdc1 is sustained until the reset pulse of ramp-down waveform (−RP) reaches to the first scan reference voltage Vyw1 of negative polarity.

The reset pulse of ramp-down waveform (−RP) causes a weak erasure discharge (=set-down discharge) at the discharge cells to erase a portion of the wall charges from respective electrodes X, Y, and Z formed excessively, so that the wall charges remain at each of the discharge cells uniformly enough to cause stable address discharge by the set-down discharge.

In the address period of selective write sub-field SW, a second DC voltage Zdc2 of positive polarity (+) is provided to the sustain electrode lines Z. The second DC voltage Zdc2 has a level lower than the first DC voltage Zdc1.

During the second DC voltage Zdc2 is provided to the sustain electrode lines Z, a selective write scan pulse SWSP of negative polarity (−) is provided to the scan electrode lines Y, and a selective write data pulse DP of positive polarity (+) synchronous to the selective write scan pulse SWSP of negative polarity (−) is provided to the address electrode lines X. In this instance, the selective write scan pulse SWSP of negative polarity (−) has a level of a second scan reference voltage Vyw2 lower than the first scan reference voltage Vyw1 provided in the set-down SD period.

As a voltage difference of the selective write scan pulse SWSP and the selective write data pulse SWDP is added to a voltage caused by the wall charges produced in the reset period, there is an address discharge caused at the discharge cell the selective write data pulse SWDP is provided thereto.

Wall charges are formed at the discharge cells selected by the address discharge enough to cause discharge when the sustain voltage Vs is provided thereto. For causing the sustain discharge at the discharge cells selected by the address discharge, a sustain pulse SUSPy, or SUSPz is provided to the scan electrode lines Y and the sustain electrode lines Z alternately in the sustain period of selective write sub-field SW.

The discharge cells selected by the address discharge has a sustain discharge, i.e., a display discharge, occurred between the scan electrode line Y and the sustain electrode line Z every time the sustain pulse SUSPy, or SUSPz is provided thereto as a voltage owing to the sustain pulse SUSPy, or SUSPz is added to wall voltages at the discharge cells.

The sustain pulse SUSPy, or SUSPz has a pulse width in a range of 2–3 μs for stabilization of the sustain discharge. This is because, though discharges are occurred substantially within a range of 0.5–1 μs after the time the sustain pulse SUSPy, or SUSPz is applied, it is required that the sustain pulse SUSPy, or SUSPz maintains the sustain voltage Vs for a period substantially in a range of 2–3 μs after the discharges for forming the wall charges enough to cause the next discharge.

Then, the reset periods of the selective erase sub-fields SE1, SE2, - - - , are omitted, and the address period is started, immediately.

In the address period of the selective erase sub-fields SE1, SE2, - - - , selective erasure pulses SESP and SEDP are provided to the scan electrode lines Y and the address electrode lines X respectively, for turning off the discharge cells. In more detail, the selective erase scan pulse SESP of negative polarity (−) is provided to the scan electrode lines Y, and the selective erase data pulse SEDP of positive polarity (+) synchronous to the selective erase scan pulse SESP is provided to the address electrode lines X. In this instance, the selective erase scan pulse SESP is provided, with a level of the selective erase scan pulse SESP dropped to a level of the selective erase scan voltage −Vye higher than the scan reference voltage −Vyw.

In the sustain period of the selective erase sub-fields SE1, SE2, - - - , for causing sustain discharge at discharge cells having not turned off by the address discharge, the sustain pulse SUSPy, or SUSPz is provided to the scan electrode lines Y and the sustain electrode lines Z, alternately. However, if the next sub-field is the selective erase field SE, at an end time of the present selective erase sub-field SE, the sustain pulse SUSPy having comparatively large pulse width is provided to the scan electrode lines Y.

In the last selective erase sub-field, an erase pulse EP and a ramp pulse are provided to the scan electrode lines Y and the sustain electrode lines Z. According to this, sustain discharges at turned on discharge cells are erased. In this instance, the next sub-field of the last selective erase sub-field is the selective write sub-field SW.

FIGS. 4A~4C illustrate forms of wall charge production in regular operation of the selective erase sub-field SE in FIG. 3.

Referring to FIGS. 4A~4C, when the sustain discharge of one of the selective write sub-fields SW1~SW6 is finished, wall charges are formed at all electrodes of the PDP as shown in FIG. 4A. Thereafter, at a time point t2 the scan pulse SESP and the data pulse SEDP are applied in the selective erase sub-field SE, no discharge is occurred as shown in FIG. 4B. At such a discharge cell, a sustain discharge is occurred as shown in FIG. 4C as the sustain pulse SUSPz is applied thereto at a t3 time point.

However, if the sustain voltage Vs of the sustain pulses SUSPy and SUSPz is too high, or the selective erase scan voltage −Vye is too low, an erratic discharge is occurred at the time point t2, when it is required that no discharge is occurred. That is, the erratic discharge is occurred between the scan electrode lines Y and the address electrode lines X, or between the scan electrode lines Y and the sustain electrode lines Z as shown in FIG. SA.

Such an erratic discharge acts as an erase discharge, impeding occurrence of the sustain discharge in the sustain period, resulting in a correct display of gradation on the entire PDP.

SUMMARY OF THE INVENTION

Accordingly, the present invention is directed to a method for driving a plasma display panel that substantially obviates one or more of the problems due to limitations and disadvantages of the related art.

An object of the present invention is to provide a method for driving a plasma display panel, which can make a stable address discharge even if a higher sustain voltage, or a lower selective erase scan voltage is applied.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for driving a PDP having 3-electrodes includes a first step of applying a pulse of ramp-down waveform to scan electrode lines between a sustain period of a last selective write sub-field and an address period of a first selective erase sub-field continuous to the last selective write sub-field, a second step of synchronizing selective scan pulses to each other for turning off discharge cells in the address period of the first selective erase sub-field, and applying to scan electrode lines and sustain electrode lines respectively, a third step of applying a sustain pulse to the scan electrode lines and the sustain electrode lines alternately in the sustain period of the first selective erase sub-field, for causing sustain discharge at discharge cells not turned off in the address period, and a fourth step of applying one more pulse of ramp-down waveform to the scan electrode lines between the sustain period of the first selective erase sub-field and the address period of the second selective erase sub-field continuous to the sustain period of the first selective erase sub-field.

More preferably, the first step includes the step of applying a pulse of ramp-down waveform having a base voltage taken as an initial voltage thereof, and a voltage having a level higher than a voltage of the selective erase scan pulse of negative polarity applied in the address period of the first selective erase sub-field taken as a decline reference voltage after the sustain period of the last selective write sub-field.

More preferably, the first step includes the step of applying a pulse of ramp-down waveform having a voltage (a sustain voltage) applied in the sustain period of the last selective write sub-field taken as an initial voltage thereof, and a voltage having a level higher than a voltage of a selective erase scan pulse of negative polarity (−) applied in the address period of the first selective erase sub-field taken as a decline reference voltage thereof after the sustain period of the last selective write sub-field.

More preferably, the fourth step includes the step of applying a pulse of ramp-down waveform having a base voltage taken as an initial voltage thereof, and a voltage having a level higher than a voltage of a selective erase scan pulse of negative polarity (−) applied in the address period of the second selective erase sub-field taken as a decline reference voltage thereof after the sustain period of the first selective erase sub-field.

More preferably, the first step includes the step of applying a pulse of ramp-down waveform having a voltage (a sustain voltage) applied in a sustain period of the first selective erase sub-field taken as an initial voltage thereof, and a voltage with a level higher than a voltage of the selective erase scan pulse of negative polarity (−) applied in the address period of the second selective erase sub-field after the sustain period of the first selective erase sub-field.

More preferably, the method for driving a PDP having 3-electrodes further includes the step of applying the pulse of ramp-down waveform to the scan electrode lines between the sustain period of a preceding first selective erase sub-field and the address period of a next second selective erase sub-field continuous to the first selective erase sub-field after the first selective erase sub-field.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
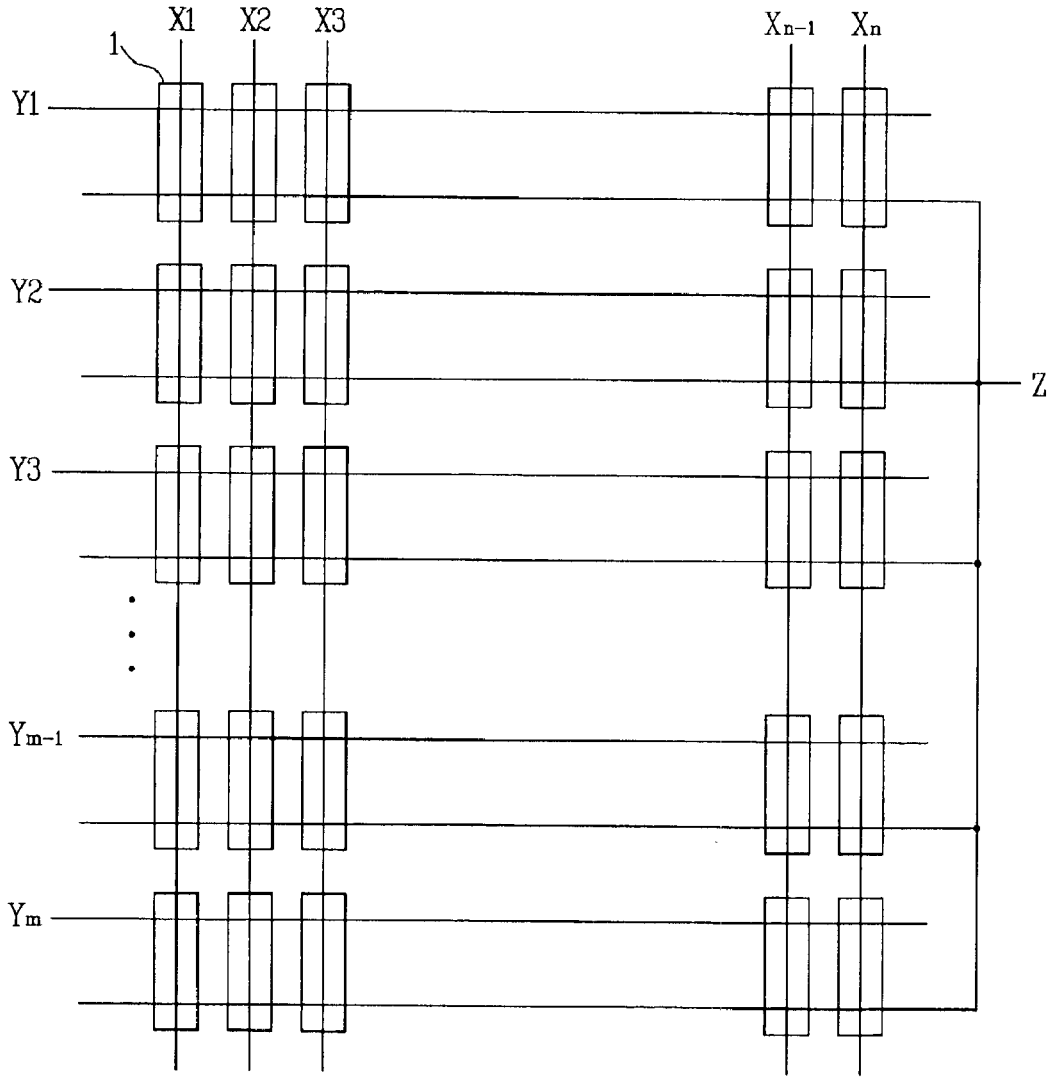
FIG.1 Related Art
FIG. 1 illustrates an electrodes arrangement of a related art AC PDP of surface discharge type having 3-electrode.
Figure 2:
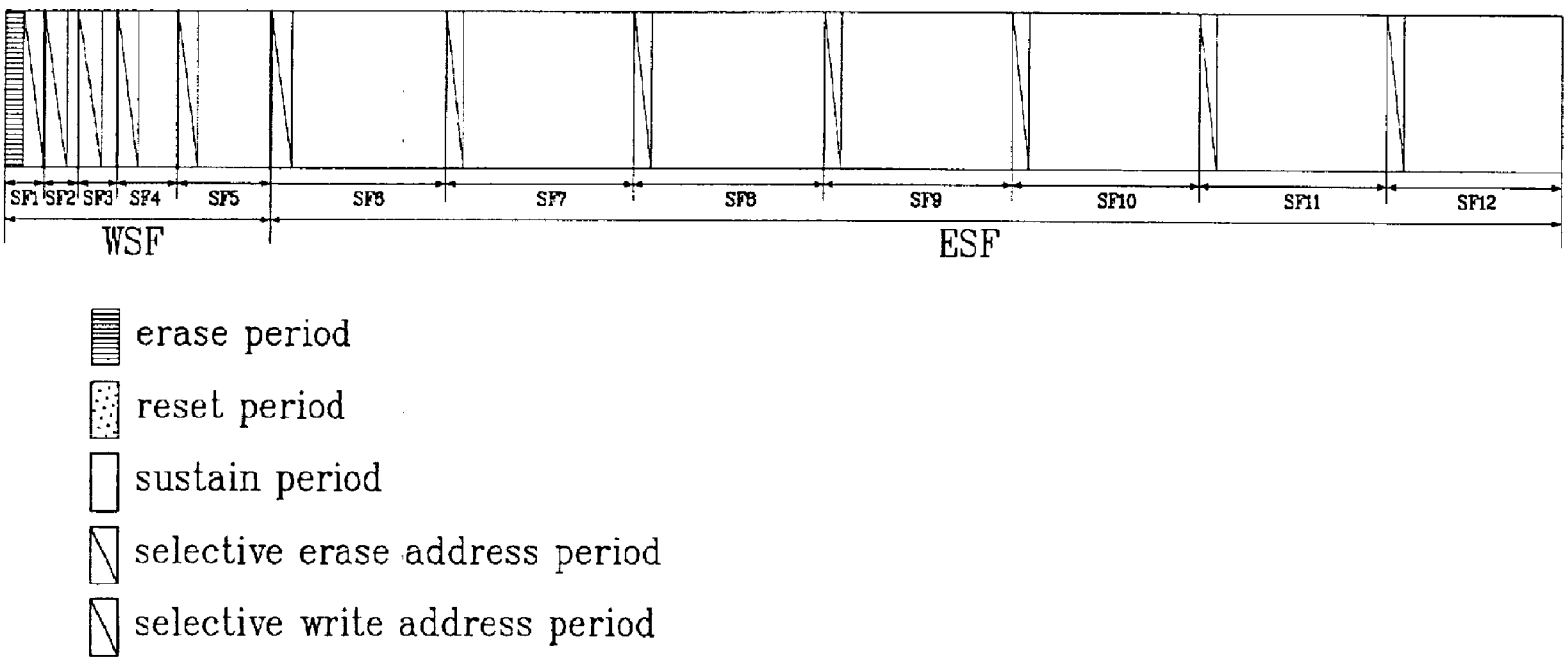
FIG.2 Related Art
FIG. 2 illustrates one example of a frame structure for driving a related art PDP.
Figure 3:
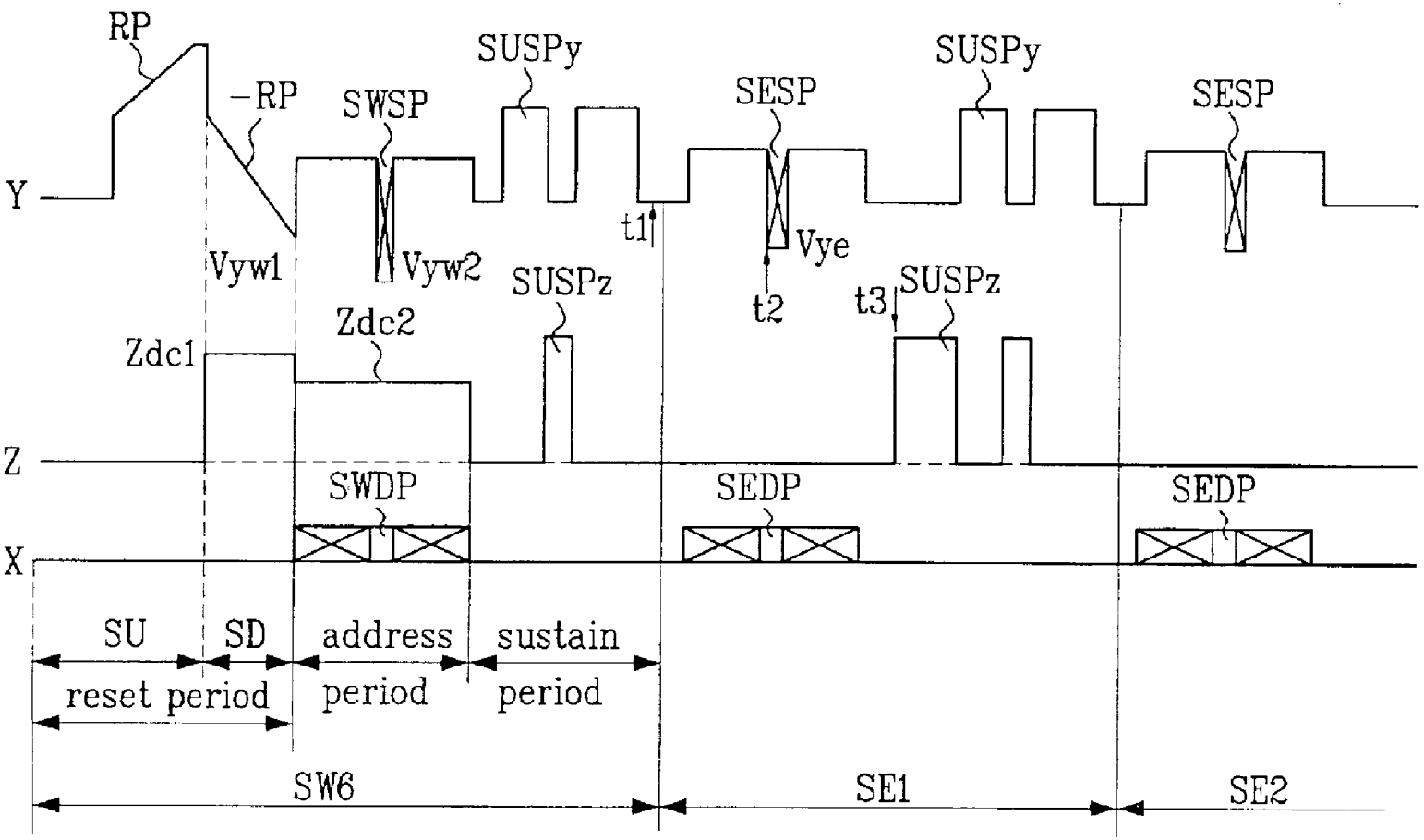
FIG.3 Related Art
FIG. 3 illustrates a waveform diagram showing an example of operative waveforms of the PDP according to the frame in FIG. 2.
Figure 4A:
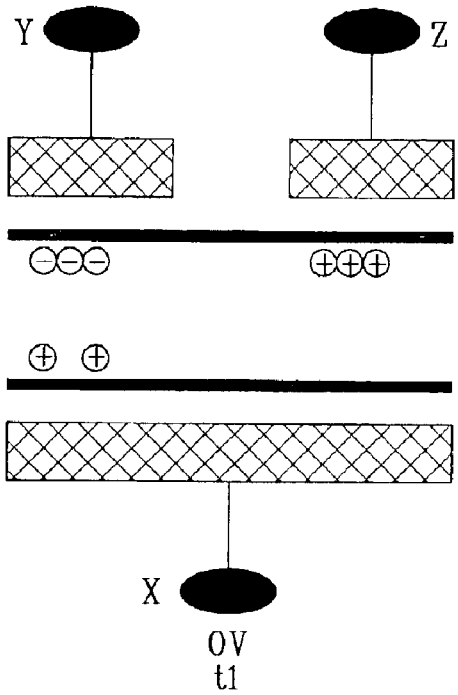
FIG. 4A Related Art
FIGS. 4A~4C illustrate forms of wall charge generation during regular operation in the selective erase sub-field SE in FIG. 3.
Figure 4B:
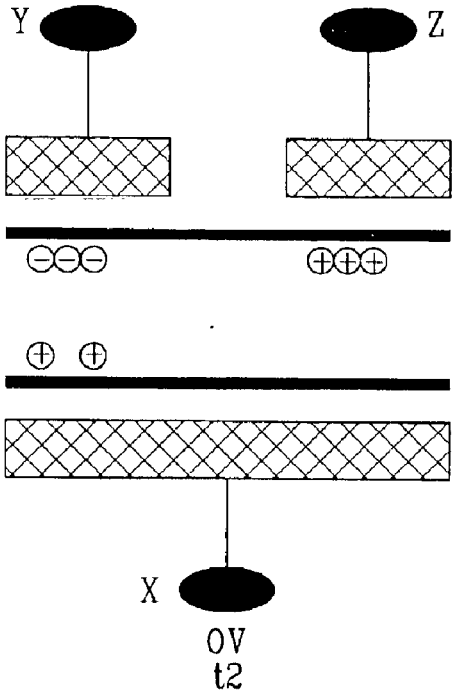
FIG. 4B Related Art
Figure 4C:
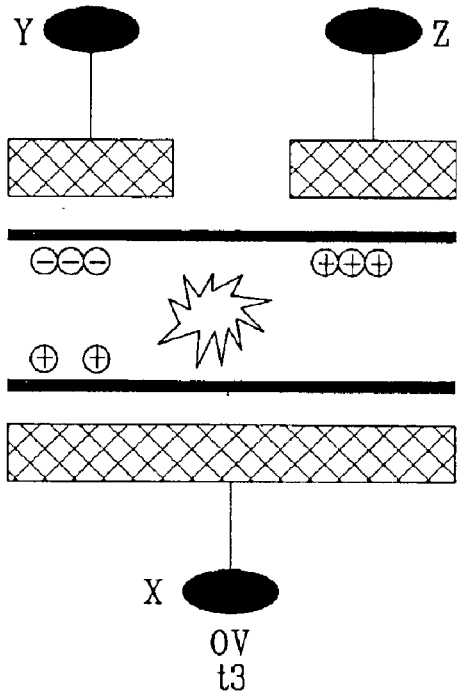
FIG. 4C Related Art
Figure 5A:
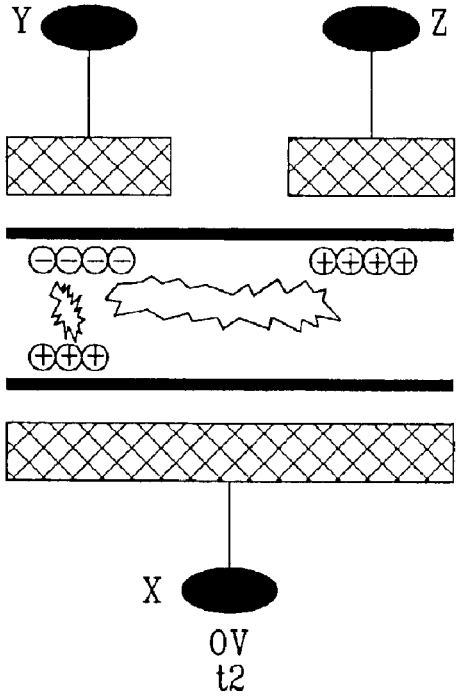
FIG. 5A Related Art
FIGS. 5A and 5B illustrate erratic discharges of related art PDPs.
Figure 5B:
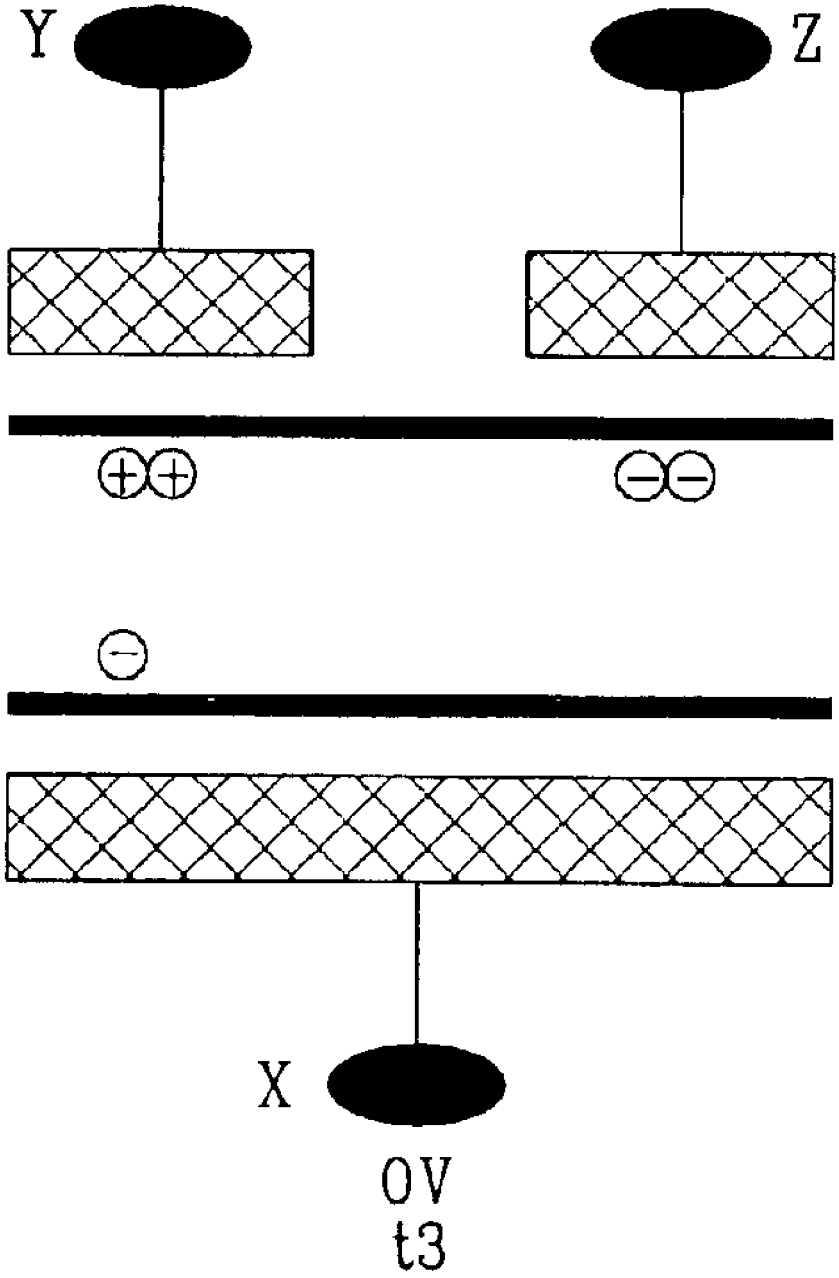
FIG.5B Related Art
Figure 6:
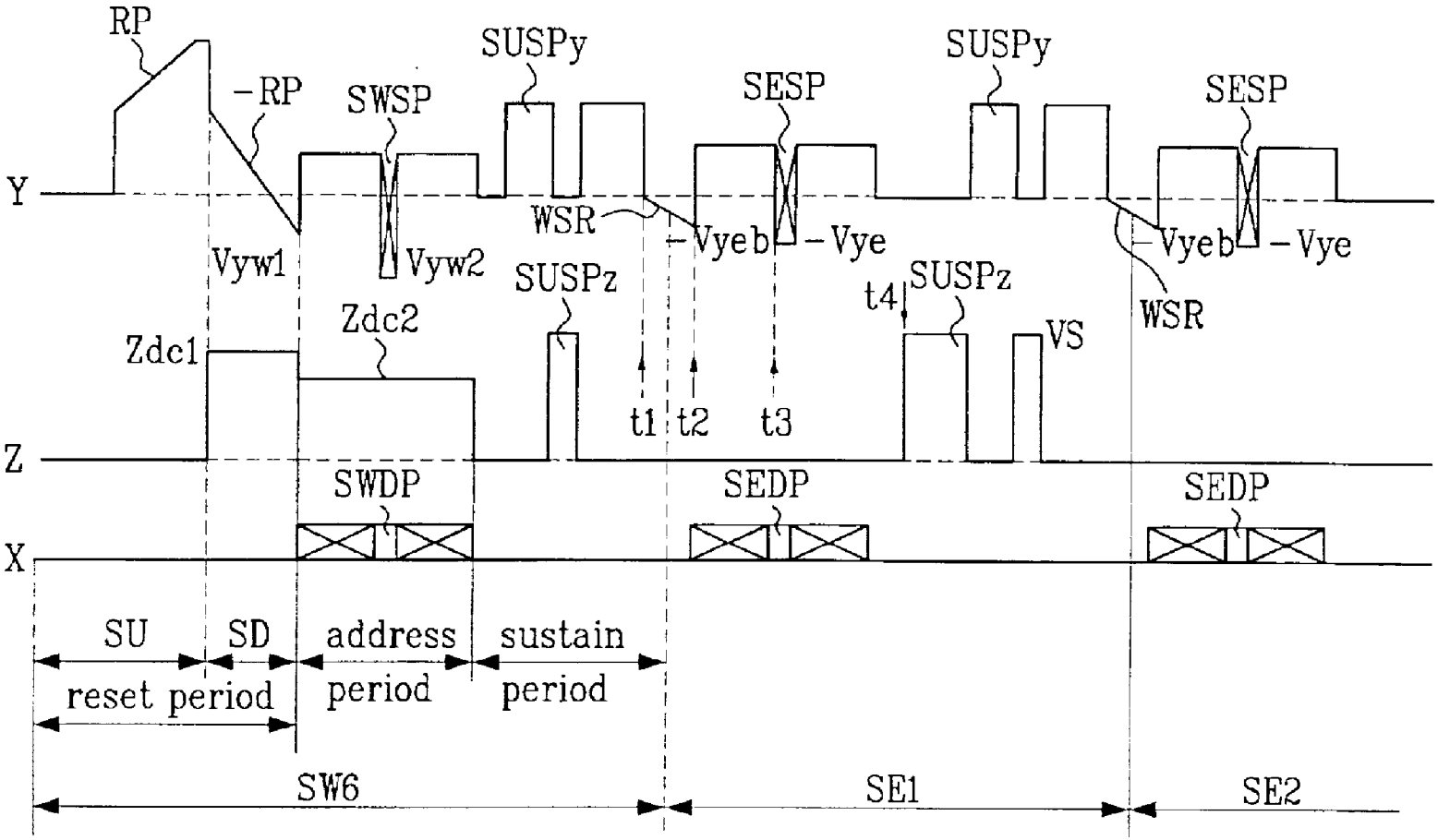
FIG. 6 illustrates a waveform diagram showing operative waveforms of a PDP in accordance with a first preferred embodiment of the present invention.

Reference will now be made in detail to the preferred embodiments of the present invention, examples of which are illustrated in the accompanying drawings FIGS. 6~8. Though only a case when one time frame is divided into 12 sub-fields SF1~SF12 in operation of an AC PDP of surface discharge type having 3-electrodes hereafter, the present invention is not limited only to the case the frame is divided into 12 sub-frames. FIG. 6 illustrates a waveform diagram showing operative waveforms of a PDP in accordance with a first preferred embodiment of the present invention.

Referring to FIG. 6, in the reset period of the sixth selective write sub-field SW6, the last selective write sub-field, a reset pulse of ramp-up waveform RP is provided to the scan electrode lines Y in an initial set-up period SU. The reset pulse of ramp-up waveform RP causes a set-up discharge in discharge cells on entire screen, to accumulate wall charges of positive polarity (+) on the address electrode lines X and the sustain electrode lines Z, and wall charges of negative polarity (−) on the scan electrode lines Y.

Then, in the set-down period SD, a reset pulse of ramp-down waveform (−RP) is provided to the scan electrode lines Y. The reset pulse of ramp-down waveform (−RP) has a declining waveform starting from a voltage of positive polarity lower than a peak voltage of a reset pulse of ramp-up waveform (RP) after the reset pulses of ramp-up waveform (RP) is provided. The reset pulse of ramp-down waveform (−RP) drops down to a first scan reference voltage Vyw1 of negative polarity (−).

While the reset pulse of ramp-down waveform (−RP) is provided to the scan electrode lines Y, a first DC voltage of positive polarity (+) is provided to the sustain electrode lines Z. That is, at the time the reset pulse of ramp-down waveform (−RP) is provided, the first DC voltage of positive polarity (+) is started to be provided to the sustain electrode lines Z. The first DC voltage Zdc1 is sustained until the reset pulse of ramp-down waveform (−RP) reaches to the first scan reference voltage Vyw1 of negative polarity.

The reset pulse of ramp-down waveform (−RP) causes a weak erasure discharge (=set-down discharge) at the discharge cells to erase a portion of the wall charges from respective electrodes X, Y, and Z formed excessively, so that the wall charges remain at each of the discharge cells uniformly enough to cause stable address discharge by the set-down discharge.

In the address period of the sixth selective write sub-field SW6, a second DC voltage Zdc2 of positive polarity (+) is provided to the sustain electrode lines Z. The second DC voltage Zdc2 has a level lower than the first DC voltage Zdc1.

During the second DC voltage Zdc2 is provided to the sustain electrode lines Z, a selective write scan pulse SWSP of negative polarity (−) is provided to the scan electrode lines Y, and a selective write data pulse DP of positive polarity (+) synchronous to the selective write scan pulse SWSP of negative polarity (−) is provided to the address electrode lines X. In this instance, the selective write scan pulse SWSP of negative polarity (−) has a level of a second scan reference voltage Vyw2 lower than the first scan reference voltage Vyw1 provided in the set-down SD period.

Once a voltage difference of the selective write scan pulse SWSP and the selective write data pulse SWDP is added to a voltage caused by the wall charges produced in the reset period, there is an address discharge caused at the discharge cell the selective write data pulse SWDP is provided thereto.

Wall charges are formed at the discharge cells selected by the address discharge enough to cause discharge when the sustain voltage Vs is provided thereto. For causing the sustain discharge at the discharge cells selected by the address discharge, a sustain pulse SUSPy, or SUSPz is provided to the scan electrode lines Y and the sustain electrode lines Z alternately in the sustain period of the sixth selective write sub-field SW6.

The discharge cells selected by the address discharge has a sustain discharge, i.e., a display discharge, occurred between the scan electrode line Y and the sustain electrode line Z every time the sustain pulse SUSPy, or SUSPz is provided thereto as a voltage owing to the sustain pulse SUSPy, or SUSPz is added to wall voltages at the discharge cells.

The sustain pulse SUSPy, or SUSPz has a pulse width in a range of 2–3 μs for stabilization of the sustain discharge. This is because, though discharges are occurred substantially within a range of 0.5–1 μs after the time the sustain pulse SUSPy, or SUSPz is applied, it is required that the sustain pulse SUSPy, or SUSPz maintains the sustain voltage Vs for a period substantially in a range of 2–3 μs after the discharges for forming the wall charges enough to cause the next discharge.

After the sustain discharge of the sixth selective write sub-field SW6 is finished, the address period of the first selective erase sub-field SE1 is started. In the present invention, a pulse of ramp-down waveform WSR is applied to the scan electrode line Y before the address period is started for stabilization of the wall charges.

After the pulse of ramp-down waveform WSR is applied for stabilization of wall charges, in the address period APD of the first selective erase sub-fields SE1, selective erasure pulses SESP and SEDP are provided to the scan electrode lines Y and the address electrode lines X respectively, for turning off the discharge cells. In more detail, the selective erase scan pulse SESP of negative polarity (−) is provided to the scan electrode lines Y, and the selective erase data pulse SEDP of positive polarity (+) synchronous to the selective erase scan pulse SESP is provided to the address electrode lines X. In this instance, the selective erase scan pulse SESP is provided, with a level of the selective erase scan pulse SESP dropped to a level of the selective erase scan voltage −Vye higher than the scan reference voltage −Vyw2.

The pulse of ramp-down waveform WSR for stabilization of the wall charges erases only the wall charges excessively accumulated due to excessively high sustain voltage Vs, and also adjusts a decline reference voltage Vyeb which fixes a slope of the pulse of ramp-down waveform WSR in an excessively low selective erase scan voltage −Vye. At the end, the pulse of ramp-down waveform WSR eliminates a cause of the erratic discharge occurrence.

In this instance, the decline reference voltage Vyeb is adjusted to a level higher than the selective erase scan voltage −Vye, making voltage margins of the sustain voltage and the selective erase scan voltage −Vye greater.

Moreover, the pulse of ramp-down waveform WSR for stabilization of the wall charges controls even the wall charges accumulated excessively at the address electrode lines X, facilitating to maintain a low voltage level of the data pulse DP.

Thus, in the PDP in accordance with a first preferred embodiment of the present invention, wall charges of all discharge cells are made uniform, permitting a stable address drive.

The pulse of ramp-down waveform WSR for stabilizing the wall charges is applied to between the selective erase sub-fields SE1~SE6 in the same fashion, and applied to the scan electrode lines Y.

In the sustain period of the next first selective erase sub-fields SE1, for causing sustain discharge at discharge cells having not turned off by the address discharge, the sustain pulse SUSPy, or SUSPz is provided to the scan electrode lines Y and the sustain electrode lines Z, alternately.

FIGS. 7A~7D illustrate forms of wall charge generation in driving the PDP in FIG. 6.

Figure 7A:
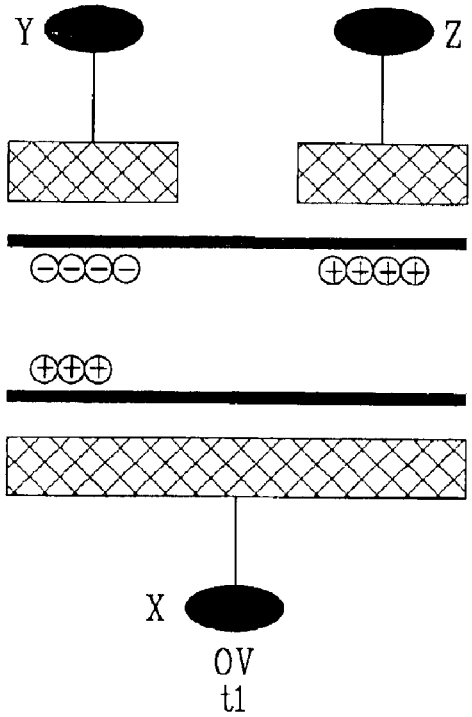
FIGS. 7A~7D illustrate forms of wall charge generation in driving the PDP in FIG. 6.

Referring to FIGS. 7A~7D, if excessively high sustain voltage Vs is applied at a time point t1 when the sustain discharge of the sixth selective write sub-field SW6 ends, excessive wall charges as shown in FIG. 7A are formed at the electrodes in the discharges cells.

For reducing a portion of the wall charges accumulated on the respective electrodes excessively, the pulse of ramp-down waveform WSR for stabilizing the wall charges is provided to the scan electrode lines Y after the sustain pulse SUSP is provided in the sustain period of a prior sub-fields SW6.

Figure 7B:
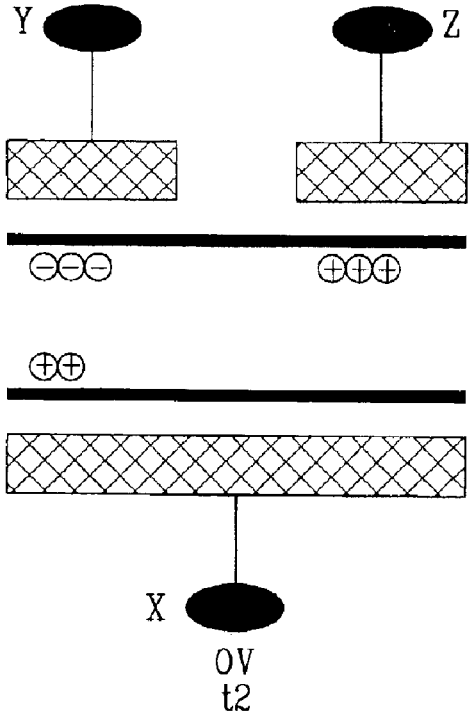
Figure 7C:
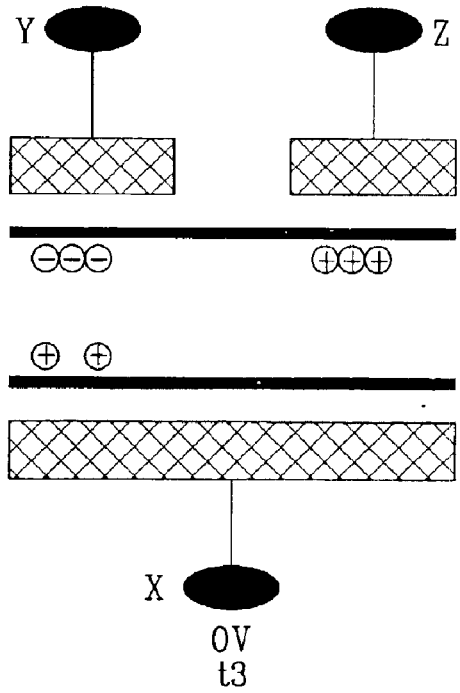

At a t2 time point when provision of the pulse of ramp-down waveform WSR for stabilizing the wall charges ends, portions of the wall charges at respective electrodes are erased as shown in FIG. 7B. As portions of the wall charges are erased, no discharges are occurred at respective electrodes in the discharge cells. In other words, as shown in FIG. 7C, no erratic discharge is occurred at a t3 time point when no data pulse DP is applied.

Figure 7D:
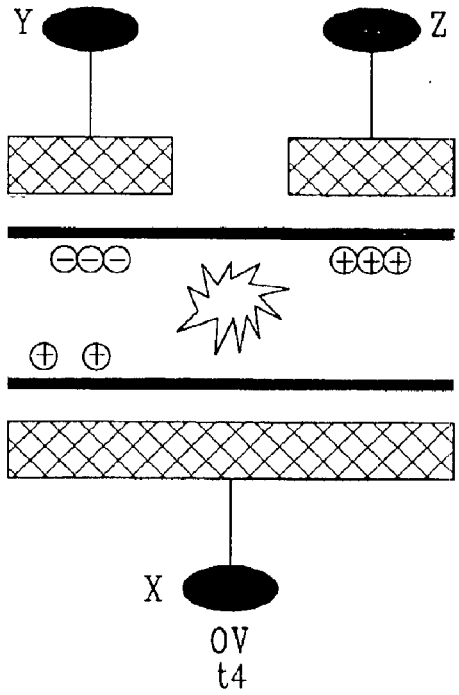

Then, at a time point t4, as the sustain pulses SUSPy, and SUSPz are applied, sustain discharges as shown in FIG. 7D are occurred at the discharge cells.

Contrary to this, at the t1 time point when the sustain discharge of the sixth selective write sub-field SW6 ends, if a regular sustain voltage Vs is applied, wall charges as shown in FIG. 7B are formed in respective electrodes in the discharge cells. Then, if a voltage level of the selective erase scan pulse SESP applied in the address period of the first selective erase sub-field SE1 is lower than the selective erase scan voltage −Vye, an erratic discharge is caused by a voltage difference of the scan pulse SESP and the data pulse SEDP.

In order to prevent occurrence of the erratic discharge, the pulse of ramp-down waveform WSR is applied between the sustain period of the sixth selective write sub-field SW6 and the address period of the first selective erase sub-field SE1.

The pulse of ramp-down waveform WSR acts as the reset pulse of ramp-down waveform −RP having applied in the set-down period SD of the selective write sub-fields SW1~SW6. That is, by erasing portions of the wall charges at respective electrodes in the discharge cells, the pulse of ramp-down waveform WSR prevents occurrence of erratic discharge between the selective erase scan pulse SESP and the selective erase data pulse SEDP.

The pulse of ramp-down waveform WSR is applied in the same fashion to between the selective erase sub-fields SE1~SE6.

Figure 8:
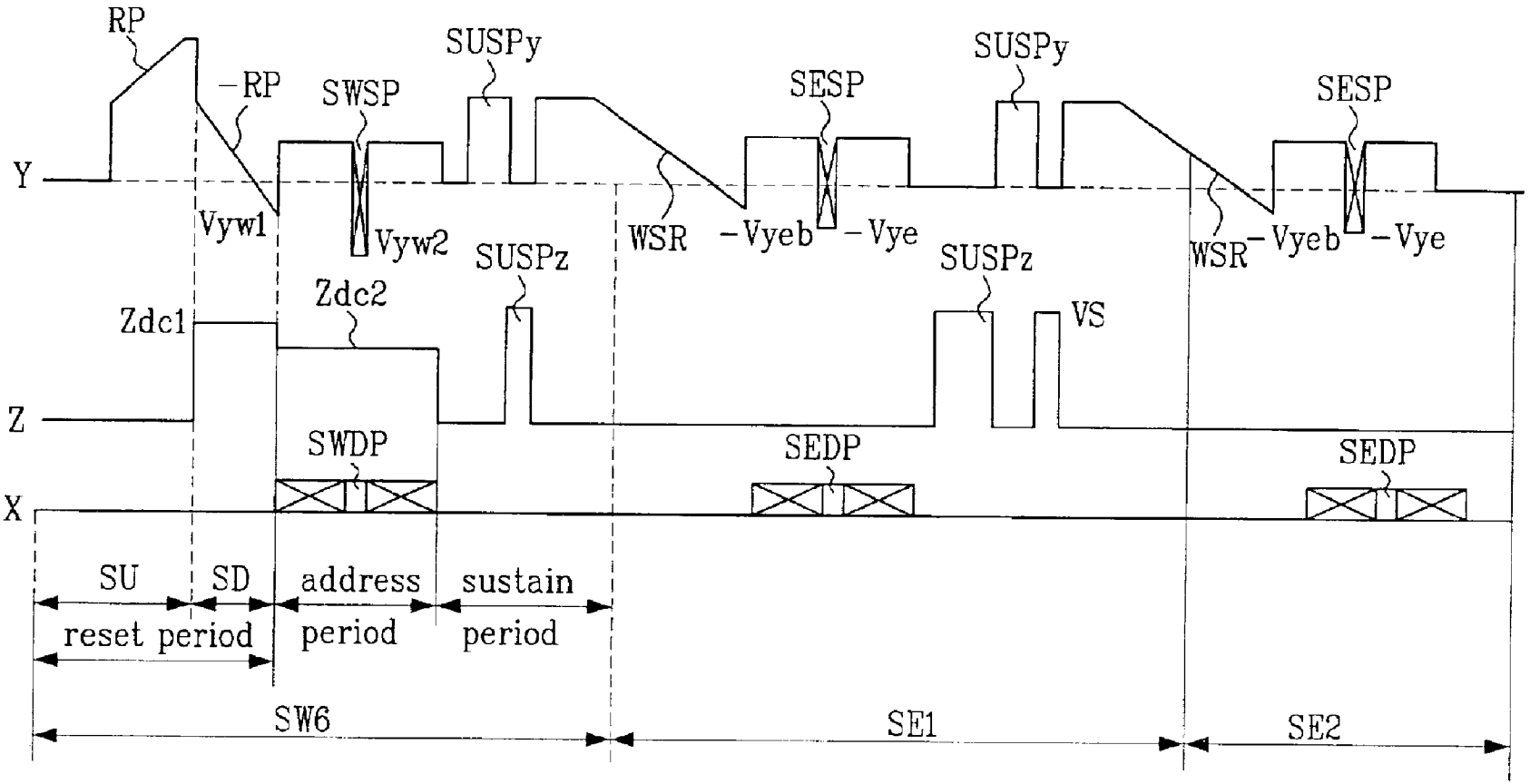
FIG. 8 illustrates a waveform diagram showing operative waveforms in driving the PDP in accordance with a second preferred embodiment of the present invention.

FIG. 8 illustrates a waveform diagram showing operative waveforms in driving the PDP in accordance with a second preferred embodiment of the present invention.

Referring to FIG. 8, in the reset period of the sixth selective write sub-field SW6, the last selective write sub-field, a reset pulse of ramp-up waveform RP is provided to the scan electrode lines Y in an initial set-up period SU. The reset pulse of ramp-up waveform RP causes a set-up discharge in discharge cells on entire screen, to accumulate wall charges of positive polarity (+) on the address electrode lines X and the sustain electrode lines Z, and wall charges of negative polarity (−) on the scan electrode lines Y.

Then, in the set-down period SD, a reset pulse of ramp-down waveform (−RP) is provided to the scan electrode lines Y.

The reset pulses of ramp waveforms are applied the same with a case of the first embodiment shown in FIG. 6.

While the reset pulse of ramp-down waveform (−RP) is provided to the scan electrode lines Y until the reset pulse of ramp-down waveform (−RP) is dropped to the first scan reference voltage Vyw1 of negative polarity, the first DC voltage Zdc1 of positive polarity is provided to the sustain electrode lines Z.

The reset pulse of ramp-down waveform (−RP) causes a weak erasure discharge (=set-down discharge) at the discharge cells to erase a portion of the wall charges from respective electrodes X, Y, and Z formed excessively.

In the address period of the sixth selective write sub-field SW6, a second DC voltage Zdc2 of positive polarity (+) is provided to the sustain electrode lines Z. The second DC voltage Zdc2 has a level lower than the first DC voltage Zdc1.

During the second DC voltage Zdc2 is provided to the sustain electrode lines Z, a selective write scan pulse SWSP of negative polarity (−) is provided to the scan electrode lines Y, and a selective write data pulse DP of positive polarity (+) synchronous to the selective write scan pulse SWSP of negative polarity (−) is provided to the address electrode lines X. In this instance, the selective write scan pulse SWSP of negative polarity (−) has a level of a second scan reference voltage Vyw2 lower than the first scan reference voltage Vyw1 provided in the set-down SD period.

Once a voltage difference of the selective write scan pulse SWSP and the selective write data pulse SWDP is added to a voltage caused by the wall charges produced in the reset period, there is an address discharge caused at the discharge cell the selective write data pulse SWDP is provided thereto.

For causing the sustain discharge at the discharge cells selected by the address discharge, a sustain pulse SUSPy, or SUSPz is provided to the scan electrode lines Y and the sustain electrode lines Z alternately in the sustain period of the sixth selective write sub-field SW6.

The discharge cells selected by the address discharge has a sustain discharge, i.e., a display discharge, occurred between the scan electrode line Y and the sustain electrode line Z every time the sustain pulse SUSPy, or SUSPz is provided thereto as a voltage owing to the sustain pulse SUSPy, or SUSPz is added to wall voltages at the discharge cells.

In the present invention, after the sustain discharge of the sixth selective write sub-field SW6 is occurred, a pulse of ramp-down waveform WSR is applied to the scan electrode lines Y for stabilizing the wall charges.

Referring to FIG. 8, a time point for starting application of the pulse of ramp-down waveform WSR is a last time point at which a last sustain pulse SUSPy sustains the sustain voltage Vs after the sustain discharge is occurred. Accordingly, the pulse of ramp-down waveform WSR is dropped down to a decline reference voltage Vyeb in a slope the same with the first preferred embodiment in FIG. 6.

After the pulse of ramp-down waveform WSR is applied for stabilization of wall charges, in the address period APD of the first selective erase sub-fields SE1, selective erasure pulses SESP and SEDP are provided to the scan electrode lines Y and the address electrode lines X respectively, for turning off the discharge cells. In more detail, the selective erase scan pulse SESP of negative polarity (−) is provided to the scan electrode lines Y, and the selective erase data pulse SEDP of positive polarity (+) synchronous to the selective erase scan pulse SESP is provided to the address electrode lines X. In this instance, the selective erase scan pulse SESP is provided, with a level of the selective erase scan pulse SESP dropped to a level of the selective erase scan voltage −Vye higher than the scan reference voltage −Vyw2.

Thus, the pulse of ramp-down waveform WSR for stabilization of the wall charges erases only the wall charges excessively accumulated due to excessively high sustain voltage Vs, and even wall charges accumulated excessively at the address electrode lines X are controlled for maintaining a low voltage level of the data pulse.

Thus, also in the PDP in accordance with a second preferred embodiment of the present invention, wall charges of all discharge cells are made uniform, permitting a stable address drive.

The pulse of ramp-down waveform WSR for stabilizing the wall charges is applied to between the selective erase sub-fields SE1~SE6 in the same fashion, and applied to the scan electrode lines Y.

In the sustain period of the next selective erase sub-fields SE, for causing sustain discharge at discharge cells having not turned off owing to the address discharge, the sustain pulse SUSPy, or SUSPz is provided to the scan electrode lines Y and the sustain electrode lines Z, alternately.

The pulse of ramp-down waveform WSR for stabilizing the wall charges is started to be provided from a last time point the last sustain pulse SUSPy sustains the sustain voltage Vs after the sustain discharge is occurred, and drops to a decline reference voltage Vyeb at a slope the same with the first embodiment in FIG. 6.

After application of the pulse of ramp-down waveform WSR for stabilizing the wall charges, a selective erase scan pulse SESP of negative polarity (−) is provided to the scan electrode lines Y for turning off the discharge cells in the next address period APD of the selective erase sub-field, and a selective erase data pulse SEDP of positive polarity (+) synchronous to the selective erase scan pulse SESP is provided to the address electrode lines X.

As has been explained, the method for driving a plasma display panel can prevent occurrence of erratic discharge caused by a too high sustain voltage Vs of the sustain pulses SUSPy and SUSPz, or a too low selective erase scan voltage −Vye, by applying the pulse of ramp-down waveform WSR for stabilizing the wall charges between the last selective write sub-field and a continuous first selective erase sub-field, or between the selective erase sub-fields, which sub-field is obtained by dividing one of frames in driving the AC PDP of surface discharge type having 3-electrodes into a plurality of sub-fields.

Especially, an address erratic discharge caused by a high temperature and a low voltage of a scan pulse can be prevented. In this instance, an initial voltage of the pulse of ramp-down waveform WSR is determined to be one of a base voltage or the sustain voltage Vs, and a decline reference voltage Vyeb of the pulse of ramp-down waveform WSR is adjusted to a voltage higher than the selective erase scan voltage −Vye, for making a voltage margin of the sustain voltage Vs and the selective erase scan voltage −Vye. At the end, a stable address discharge is made available.

It will be apparent to those skilled in the art that various modifications and variations can be made in the method for driving a plasma display panel of the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel (PDP) having 3-electrodes comprising:

a first step of applying a pulse of ramp-down waveform between a sustain period of a first sub-field and an address period of a second sub-field continuous to the sustain period of a first sub-field; and a second step of applying selective scan pulses in the address period of the second sub-field for turning off discharge cells.

2. A method as claimed in claim 1, the PDP to be driven in at least more than one selective write sub-fields for expressing a low gradation by turning on selected discharge cells and sustaining discharges of the turned on discharge cells, and at least more than one selective erase sub-fields for expressing a high gradation by turning on selected discharge cells and turning off the turned on discharge cells one by one, wherein the first step includes the step of applying a pulse of ramp-down waveform to the scan electrode line between a sustain period of a last selective write sub-field and an address period of a first selective erase sub-field continuous to the sustain period of a last selective write sub-field.

3. A method as claimed in claim 2, wherein the first step includes the step of applying a pulse of ramp-down waveform having a base voltage taken as an initial voltage thereof, and a voltage having a level higher than a voltage of a selective erase scan pulse of negative polarity (−) applied in the address period of the first selective erase sub-field taken as a decline reference voltage thereof.

4. A method as claimed in claim 2, wherein the first step includes the step of applying a pulse of ramp-down waveform having a voltage (a sustain voltage) applied in the sustain period of the last selective write sub-field taken as an initial voltage thereof, and a voltage having a level higher than a voltage of a selective erase scan pulse of negative polarity (−) applied in the address period of the first selective erase sub-field taken as a decline reference voltage thereof.

5. A method as claimed in claim 1, the PDP to be driven in at least more than one selective write sub-fields for expressing a low gradation by turning on selected discharge cells and sustaining discharges of the turned on discharge cells, and at least more than one selective erase sub-fields for expressing a high gradation by turning on selected discharge cells and turning off the turned on discharge cells one by one, wherein the first step includes the step of applying a pulse of ramp down waveform between the sustain period of the first selective erase sub-field and the address period of a next selective erase sub-field continuous to the sub-field of the first selective erase sub-field.

6. A method as claimed in claim 5, wherein the first step includes the step of applying a pulse of ramp-down waveform having a base voltage taken as an initial voltage thereof, and a voltage having a level higher than a voltage of a selective erase scan pulse of negative polarity (−) applied in the address period of the second selective erase sub-field taken as a decline reference voltage thereof.

7. A method as claimed in claim 5, wherein the first step includes the step of applying a pulse of ramp-down waveform having a voltage (a sustain voltage) applied in a sustain period of the first selective erase sub-field taken as an initial voltage thereof, and a voltage with a level higher than a voltage of the selective erase scan pulse of negative polarity (−) applied in the address period of the second selective erase sub-field.

8. A method as claimed in claim 1, wherein the first step includes the step of causing sustain discharge at discharge cells selected by the address discharge in the first sub-field, and erasing excessive wall charges in the discharge cells by applying a pulse of ramp-down waveform to the scan electrode lines after the sustain discharge.

9. A method as claimed in claim 1, wherein the first step includes the step of applying a pulse of ramp-down waveform having a base voltage taken as an initial voltage thereof.

10. A method as claimed in claim 1, wherein the first step includes the step of applying a pulse of ramp-down waveform having a voltage (sustain voltage) of the sustain pulse applied in the sustain period of the first sub-field taken as an initial voltage thereof.

11. A method as claimed in claim 1, wherein the first step includes the step of applying a pulse of ramp-down waveform having a voltage with a level higher than a voltage of the scan pulse of negative polarity applied in the address period of the second sub-field taken as a decline reference voltage.

12. A method for driving a PDP having 3-electrodes, comprising:

a first step of applying a pulse of ramp-down waveform to scan electrode lines between a sustain period of a last selective write sub-field and an address period of a first selective erase sub-field continuous to the last selective write sub-field;

a second step of synchronizing selective scan pulses to each other for turning off discharge cells in the address period of the first selective erase sub-field, and applying to scan electrode lines and sustain electrode lines, respectively;

a third step of applying a sustain pulse to the scan electrode lines and the sustain electrode lines alternately in the sustain period of the first selective erase sub-field, for causing sustain discharge at discharge cells not turned off in the address period; and a fourth step of applying one more pulse of ramp-down waveform to the scan electrode lines between the sustain period of the first selective erase sub-field and the address period of the second selective erase sub-field continuous to the sustain period of the first selective erase sub-field.

13. A method as claimed in claim 12, wherein the first step includes the step of applying a pulse of ramp-down waveform having a base voltage taken as an initial voltage thereof, and a voltage having a level higher than a voltage of the selective erase scan pulse of negative polarity applied in the address period of the first selective erase sub-field taken as a decline reference voltage after the sustain period of the last selective write sub-field.

14. A method as claimed in claim 12, wherein the first step includes the step of applying a pulse of ramp-down waveform having a voltage (a sustain voltage) applied in the sustain period of the last selective write sub-field taken as an initial voltage thereof, and a voltage having a level higher than a voltage of a selective erase scan pulse of negative polarity (−) applied in the address period of the first selective erase sub-field taken as a decline reference voltage thereof after the sustain period of the last selective write sub-field.

15. A method as claimed in claim 12, wherein the fourth step includes the step of applying a pulse of ramp-down waveform having a base voltage taken as an initial voltage thereof, and a voltage having a level higher than a voltage of a selective erase scan pulse of negative polarity (−) applied in the address period of the second selective erase sub-field taken as a decline reference voltage thereof after the sustain period of the first selective erase sub-field.

16. A method as claimed in claim 12, wherein the first step includes the step of applying a pulse of ramp-down waveform having a voltage (a sustain voltage) applied in a sustain period of the first selective erase sub-field taken as an initial voltage thereof, and a voltage with a level higher than a voltage of the selective erase scan pulse of negative polarity (−) applied in the address period of the second selective erase sub-field after the sustain period of the first selective erase sub-field.

17. A method as claimed in claim 12, wherein the first or the fourth step includes the step of applying the pulse of ramp-down waveform before the address period of the selective erase sub-field.

18. A method as claimed in claim 12, further comprising the step of applying the pulse of ramp-down waveform to the scan electrode lines between the sustain period of a preceding first selective erase sub-field and the address period of a next second selective erase sub-field continuous to the first selective erase sub-field after the first selective erase sub-field.

* * * * *